US005932960A

United States Patent [19]

Terada et al.

[11] Patent Number: 5,932,960

[45] Date of Patent: Aug. 3, 1999

[54] FLUORESCENT LAMP HAVING AN EXTERNAL ELECTRODE ON THE OUTER SURFACE AND AN INTERNAL ELECTRODE THAT IS FIXED TO THE ANNULAR INNER SURFACE BY A LOW MELTING POINT GLASS

[75] Inventors: Toshiyuki Terada, Tokyo; Kazuaki Kawasaki, Kanagawa-ken, both of Japan

[73] Assignee: Stanley Electric Co., Ltd., Tokyo, Japan

[21] Appl. No.: 08/929,218

[22] Filed: Sep. 9, 1997

[30] Foreign Application Priority Data

Jun. 27, 1997 [JP] Japan ..... 9-171989

[51] Int. Cl.[6] ..... H01J 1/62; H01J 63/04; H01J 11/00; H01J 65/00

[52] U.S. Cl. ..... 313/485; 313/234; 313/491; 313/493; 313/607; 313/631; 313/634; 313/635

[58] Field of Search ..... 313/234, 246, 313/249, 251, 485, 488, 491–93, 594, 597, 601–2, 607, 631, 634, 637

[56] References Cited

U.S. PATENT DOCUMENTS 5,757,132 5/1998 Matsuno et al. .

5,763,999 6/1998 Matsuno et al. .

FOREIGN PATENT DOCUMENTS 7272692 10/1995 Japan .

7272694 10/1995 Japan .

9283091 10/1997 Japan .

*Primary Examiner*—Sandra O'Shea

*Assistant Examiner*—Mark Haynes

*Attorney, Agent, or Firm*—Weingarten, Schurgin, Gagnebin & Hayes LLP

[57] ABSTRACT

There is provided a fluorescent lamp comprising a tubular glass bulb, a fluorescent layer formed on an inner surface of the tubular glass, an external electrode provided on an outer surface of the tubular glass bulb, and an internal electrode provided on the inner surface of the tubular glass bulb, wherein the internal electrode formed from a conductive member is fixed on the inner surface of the tubular glass bulb by a glass having a low melting point to be in close contact with the inner surface of the tubular glass bulb. This makes it possible to arrange the tubular glass bulb and the internal electrode which have different thermal expansion coefficients without any problem due to resonance with vibration.

4 Claims, 2 Drawing Sheets

FLUORESCENT LAMP HAVING AN EXTERNAL ELECTRODE ON THE OUTER SURFACE AND AN INTERNAL ELECTRODE THAT IS FIXED TO THE ANNULAR INNER SURFACE BY A LOW MELTING POINT GLASS

BACKGROUND OF THE INVENTION

1. Field of the Invention

This invention relates to a fluorescent lamp comprising a pair of electrodes and, more specifically, to a fluorescent lamp in which one of the electrodes is provided outside a discharge chamber as an external electrode and the other electrode is provided inside the discharge chamber as an internal electrode so as to cause discharge through a tubular glass bulb which is a dielectric.

2. Background Art

FIG. 6 shows an example of this type of fluorescent lamp 90 of the prior art which comprises a tubular glass bulb 91 having a fluorescent layer 92 formed on the inner surface, and a pair of electrodes. The tubular glass bulb is sealed at both ends, air is exhausted from and a gas is charged into the tubular glass bulb 91 to form a discharge chamber 91*a*. One of the electrode is an external electrode 93 provided on the outer surface of the tubular glass bulb 91.

The other of the electrodes is an internal electrode 94 formed of a metal wire and provided substantially at the center in an axial direction of the tubular glass bulb 91 in the discharge chamber 91*a*. To prevent excessive tensile stress or sag generated by the difference of thermal expansion coefficient between the tubular glass bulb 91 and the metal wire (i.e., the internal electrode 94), the metal wire is formed into a coil and is given appropriate tension when it is installed.

In the fluorescent lamp 90 of the prior art described above, since a coil is used as the internal electrode 94, the problem caused by the difference of thermal expansion coefficient is solved. However, the internal electrode 94 resonates with vibration, freely vibrates and contacts the fluorescent layer 92 formed on the inner surface of the tubular glass bulb 91, thereby scratching or removing the fluorescent layer 92 from the glass bulb 91.

This problem cannot be ignored because the fluorescent lamp 90 may be used as a back light source for a liquid crystal display which is used for a car TV receiver or a car navigation system in many cases and is easily vibrated by the running of a vehicle.

SUMMARY OF THE INVENTION

An object of the present invention for solving the above problems of the prior art is to provide a fluorescent lamp comprising a tubular glass bulb, a fluorescent layer formed on an inner surface of the tubular glass, an external electrode provided on an outer surface of the tubular glass bulb, and an internal electrode provided on the inner surface of the tubular glass bulb, wherein the internal electrode formed from a conductive member is fixed on the inner surface of the tubular glass bulb by a glass having a low melting point to be in close contact with the inner surface of the tubular glass bulb.

Another object of the present invention is to provide a fluorescent lamp as above in which the conductive member for the internal electrode is a material selected from the group consisting of a metal wire, a metal ribbon, and a metal powders.

Still another object of the present invention is to provide a fluorescent lamp as above in which the external electrode is comprised of a pair of separate electrodes provided on a position other than the outer surface substantially corresponding to the inner surface of the tubular glass bulb where the internal electrode is formed.

BRIEF DESCRIPTION OF THE DRAWINGS

These and other objects and advantages of the present invention will become clear from the following description with reference to the accompanying drawings, wherein.

DETAILED DESCRIPTION OF THE PREFERRED EMBODIMENTS

Figure 1:
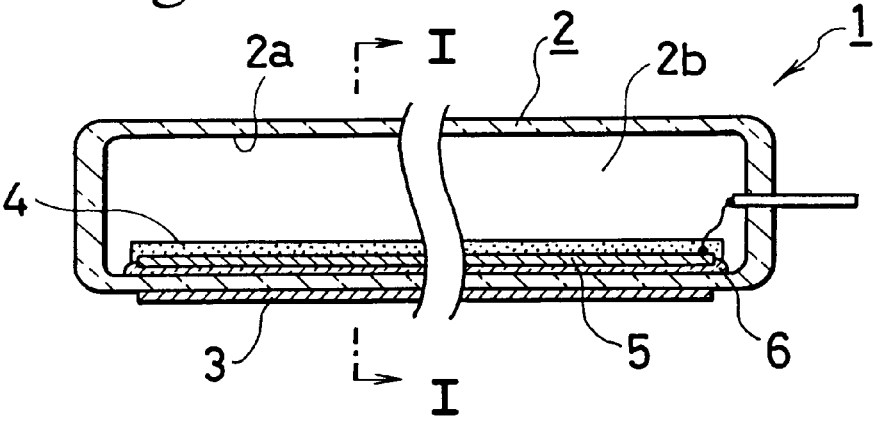
FIG. 1 is a sectional view of a fluorescent lamp according to a first embodiment of the present invention.
Figure 2:
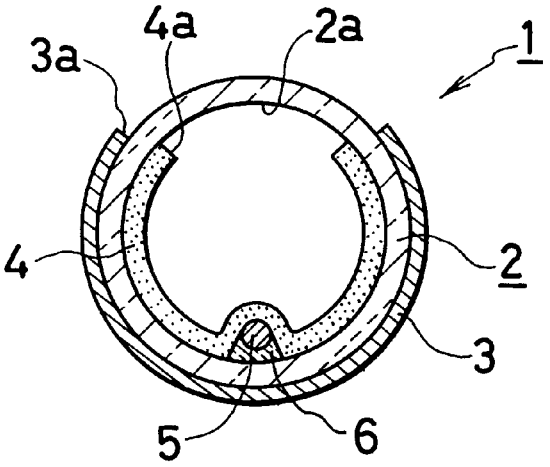
FIG. 2 is a sectional view taken on line A—A of FIG. 1.

The present invention is described in detail hereinafter with reference to embodiments shown in the accompanying drawings. In FIGS. 1 and 2, numeral 1 designates a fluorescent lamp according to a first embodiment of the present invention. This fluorescent lamp 1 comprises a tubular glass bulb 2, an external electrode 3 provided on the outer surface of the tubular glass bulb 2, a fluorescent layer 4, and an internal electrode 5 provided on the inner surface of the tubular glass bulb like the prior art.

The internal electrode 5 is provided along an axial direction of the tubular glass bulb 2, however, in the present invention, the internal electrode 5 is provided in contact with the inner surface 2*a* of the tubular glass bulb 2. In the first embodiment of the present invention, a metal wire such as a tungsten wire is used as the internal electrode 5.

In the present invention, the internal electrode is fixed on the inner surface 2*a* of the tubular glass bulb 2 by a glass having a low melting point which is prepared by adding selenium, thallium, arsenic, sulfur or the like to set its melting point to about 130–350° C. (260–660° F.) (hereinafter called as "low-melting glass 6"). The cross section of the internal electrode 5 is preferably set to a small area that do not interfere with the application of a discharge current, for example, smaller than the cross section of the tubular glass bulb 2 from a viewpoint of relieving stress, which will be described hereinafter.

The fluorescent layer 4 is formed on the inner surface 2*a* of the tubular glass bulb 2 on which the internal electrode 5 is fixed as described above, the tubular glass bulb 2 is then sealed at both ends, and air is exhausted from and a gas is charged into the tubular glass bulb 2 to form a discharge chamber 2*b*, thereby constructing the fluorescent lamp 1 of the present invention.

A fluorescent layer window portion 4*a* is provided in the fluorescent layer 4 in an axial direction of the tubular glass bulb 2, and an external electrode window portion 3*a* is also provided in the external electrode 3 at a position corresponding to the fluorescent layer window portion 4*a* so that light emitted from the fluorescent layer 4 is taken out efficiently to a desired direction of the outside like the prior art.

A description is subsequently given of the function and effect of the fluorescent lamp 1 of the present invention configured as described above. Since the internal electrode 5 is integrated with the interior wall 2*a* by the low-melting glass 6, thermal expansion of the internal electrode 5 having a larger thermal expansion coefficient than that of the tubular glass bulb 2 is reduced by this integration. In other words, a degree of thermal expansion of the internal electrode 5 can be approximated to that of the tubular glass bulb 2.

Thereby, when rising a temperature of the lamp is caused by lighting, it can be prevented to occur sag in the internal electrode 5 by expansion. Therefore, in the present invention, when vibration is applied, e.g., by the running of a vehicle, the internal electrode 5 which does not resonate with the vibration and does not freely vibrate can be installed inside the discharge chamber 2*b* without forming the electrode into a coil.

Therefore, the present invention makes it possible to provide a fluorescent lamp 1 which has no possibility of scratching or removing the fluorescent layer 4 as a back light source for a liquid crystal display for a car TV receiver, to reduce a volume occupied by the internal electrode 5 in the discharge chamber 2*b* by eliminating the need for forming the internal electrode 5 into a coil, and to further reduce the diameter of the tubular glass bulb 2.

Figure 3:
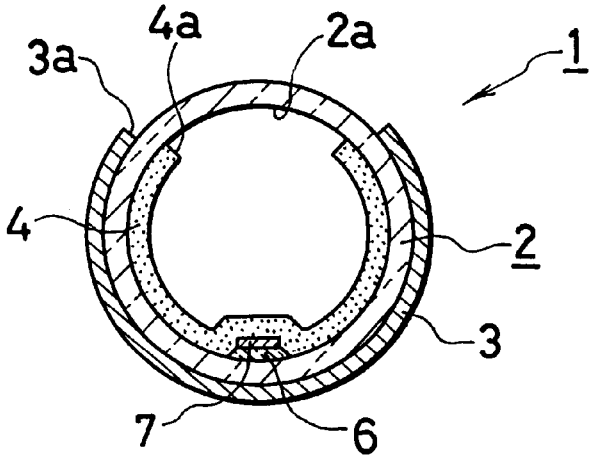
FIG. 3 is a sectional view of a fluorescent lamp according to a second embodiment of the present invention.

FIG. 3 shows a second embodiment of the present invention. While the internal electrode 5 is formed as a metal wire in the above first embodiment, an internal electrode 7 is formed as a metal ribbon in this second embodiment and is integrated with the inner surface 2*a* of the tubular glass bulb by the low-melting glass 6 like the first embodiment.

In this way, the surface area of the internal electrode 7 formed as a metal ribbon is larger than that of the internal electrode formed as a metal wire in the first embodiment when they are formed to have the same cross sectional area. This increases the contact areas with both the low-melting glass 6 and the interior wall 2*a* of the tubular glass bulb 2.

Therefore, the strength of integration by the low-melting glass 6 is further improved and the internal electrode 7 is hardly removed from the inner surface 2*a* by temperature variations, thereby improving reliability. The function and effect other than the above of the second embodiment are the same as those of the first embodiment.

Figure 4:
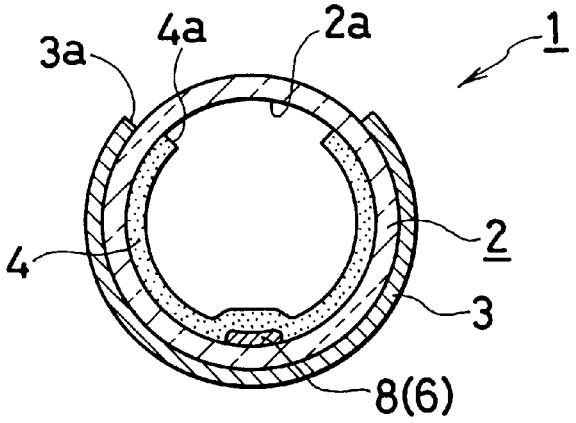
FIG. 4 is a sectional view of a fluorescent lamp according to a third embodiment of the present invention.

FIG. 4 shows a third embodiment of the present invention. Although there is some difference in degree in all of the previous embodiments, it is inevitable that stress is generated between the tubular glass bulb 2 and the internal electrode 5 (or the internal electrode 7 in the second embodiment) upon a temperature variation. In this third embodiment, the above stress is made substantially null to eliminate stress.

To achieve the above object, in this embodiment, low-melting glass powders and metal powders such as silver are mixed and formed into a paste using an appropriate binder and solvent, and the paste is then coated on the interior wall 2*a* of the tubular glass bulb 2 as an appropriate form by such means as printing and baked to be integrated with the inner surface 2*a* of the tubular glass bulb 2 as the internal electrode 8.

Figure 5:
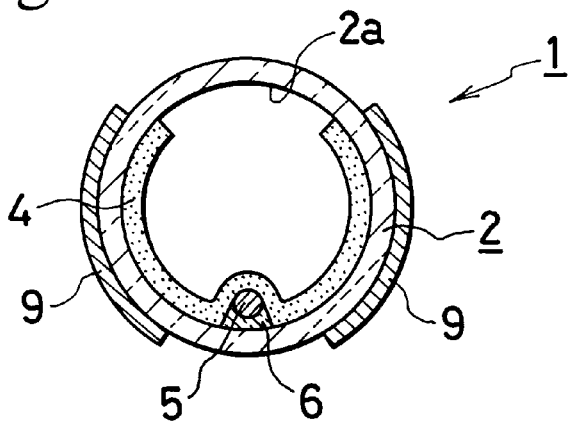
FIG. 5 is a sectional view of a fluorescent lamp according to a fourth embodiment of the present invention.
Figure 6:
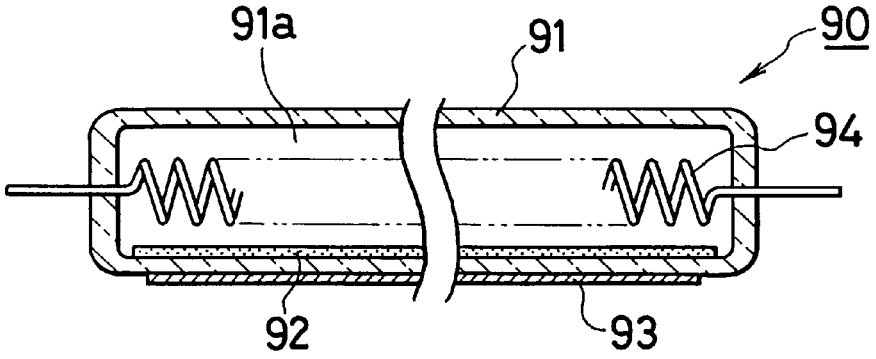
Fig. 6 Prior Art
FIG. 6 is a sectional view of a fluorescent lamp according to the prior art.

FIG. 5 shows a fourth embodiment of the present invention. In all of the first to third embodiments described above, as the internal electrode 5 (or 7, 8) is formed on the inner surface 2*a* of the tubular glass bulb 2, there is the difference of the distance between the internal electrode and the external electrode 3, whereby power for discharging may concentrate on a portion where the internal electrode 5 (or 7, 8) and the external electrode 3 are very close to each other.

To cope with this problem, the present invention provides an external electrode 9 whose portion corresponding to the inner surface 2*a* of the tubular glass bulb on which the internal electrode 5 (or 7, 8) is provided is removed, or a pair of electrodes for the external electrode are separately provided. The difference of the distance between the internal electrode 5, (7, 8) and the external electrode 9 is reduced, thereby making it possible to prevent excessive discharge power from concentrating on a portion and the partial deterioration of the fluorescent layer 4, for example.

As described above, since the fluorescent lamp of the present intention is configured such that the internal electrode formed from a conductive member is fixed on the inner surface of the tubular glass bulb by a low-melting glass to be in close contact with the wall of the inner surface, the internal electrode is integrated with the inner surface by the low-melting glass. The tubular glass bulb and the internal electrode which have different thermal expansion coefficients can be arranged in close contact with each other.

In addition, the internal electrode does not resonate with vibration from the outside and does not freely vibrate. When the fluorescent lamp of the present invention is used as a back light source for a car liquid crystal display, it does not cause such inconvenience that the fluorescent layer is scratched or removed by the free vibration of the internal electrode. Therefore, the present invention provides an extremely excellent effect that reliability is improved by preventing malfunction.

Since the fluorescent lamp of the present invention is configured such that the external electrode is removed at a position of the outer surface substantially corresponding to the inner surface of the tubular glass bulb where the internal electrode is formed, the partial concentration of a discharge current generated by the formation of the internal electrode on the inner surface of the tubular glass bulb to be in close contact with the interior wall is prevented. Therefore, the present invention provides such an extremely excellent effect that the practical applicability of the fluorescent lamp is improved.

While the presently preferred embodiments of the present invention have been shown and described, it will be understood that the present invention is not limited thereto, and that various changes and modifications may be made by those skilled in the art without departing from the scope of the invention as set forth in the appended claims.

What is claimed is:

1. A fluorescent lamp comprising a tubular glass bulb, a fluorescent layer formed on an inner annular surface of the tubular glass, an external electrode provided on an outer surface of the tubular glass bulb, and an internal electrode provided on the inner annular surface of the tubular glass bulb, wherein the internal electrode formed from a conductive member is fixed on the inner annular surface of the tubular glass bulb by a glass having a low melting point to be in close contact with the inner annular surface of the tubular glass bulb.

2. The fluorescent lamp according to claim 1 wherein the external electrode is comprised of a pair of separate electrodes provided on a position on the outer surface of the tubular glass bulb other than the outer surface substantially corresponding to the inner annular surface of the tubular glass bulb where the internal electrode is formed.

3. The fluorescent lamp according to claim 1, wherein the conductive member for the internal electrode is a material selected from the group consisting of a metal wire, a metal ribbon, and a metal powder.

4. The fluorescent lamp according to claim 3 wherein the external electrode is comprised of a pair of separate electrodes provided on a position on the outer surface of the tubular glass bulb other than the outer surface substantially corresponding to the inner annular surface of the tubular glass bulb where the internal electrode is formed.

* * * * *

UNITED STATES PATENT AND TRADEMARK OFFICE

CERTIFICATE OF CORRECTION

PATENT NO. : 5,932,960
DATED : August 3, 1999
INVENTOR(S) : Toshiyuki Terada et al.

It is certified that error appears in the above-identified patent and that said Letters Patent is hereby corrected as shown below:

Title page, item 54 and column 1,
Title, reads "FLUORESCENT LAMP HAVING AN EXTERNAL ELECTRODE ON THE OUTER SURFACE AND AN INTERNAL ELECTRODE THAT IS FIXED TO THE ANNULAR INNER SURFACE BY A LOW MELTING POINT GLASS", should read -- FLOURESCENT LAMP HAVING AN EXTERNAL ELECTRODE ON THE OUTER SURFACE AND AN INTERNAL ELECTRODE THAT IS FIXED TO THE ANNULAR INNER SURFACE BY A LOW MELTING POINT --;

Column 2,
Line 15, "A-A", should read -- I-I --.

Signed and Sealed this

Twenty-fifth Day of December, 2001

*Attest:*

*Attesting Officer*

JAMES E. ROGAN
*Director of the United States Patent and Trademark Office*